US011376860B2

(12) United States Patent
Smith et al.

(10) Patent No.: US 11,376,860 B2
(45) Date of Patent: Jul. 5, 2022

(54) PRINTING FLUID CONTAINER

(71) Applicant: Hewlett-Packard Development Company, L.P., Spring, TX (US)

(72) Inventors: Ben Smith, Leixlip (IE); Bryan Murphy, Leixlip (IE); Christopher Wallace, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 35 days.

(21) Appl. No.: 16/630,170

(22) PCT Filed: Jul. 17, 2017

(86) PCT No.: PCT/US2017/042401

§ 371 (c)(1),
(2) Date: Jan. 10, 2020

(87) PCT Pub. No.: WO2019/017881

PCT Pub. Date: Jan. 24, 2019

(65) Prior Publication Data

US 2020/0230968 A1 Jul. 23, 2020

(51) Int. Cl.
*B41J 2/175* (2006.01)

(52) U.S. Cl.
CPC ..... *B41J 2/17553* (2013.01); *B41J 2/17506* (2013.01)

(58) Field of Classification Search
CPC ..... B41J 2/17553; B41J 2/17513; B41J 2/17566; B41J 2/175; B41J 29/38; B41J 2/17503; B41J 2002/17589; B41J 2/17506
See application file for complete search history.

(56) References Cited

U.S. PATENT DOCUMENTS

| | | | |
|---|---|---|---|
| 6,223,131 | B1 | 4/2001 | Kanaya et al. |
| 2002/0140749 | A1 | 10/2002 | Su |
| 2003/0193552 | A1 | 10/2003 | Tham |
| 2007/0140708 | A1 | 6/2007 | Yonekawa et al. |
| 2009/0244219 | A1 | 10/2009 | Liu |
| 2009/0244222 | A1 | 10/2009 | Aoyama |

FOREIGN PATENT DOCUMENTS

EP 1247652 B1 11/2006

OTHER PUBLICATIONS

Canon ~ G4000 Series Online Manual, 465 pages (first 19 pages) http://gdlp01.c-wss.com/ ~ retrieve Dec. 13, 2019.
EPSON ~ User's Guide ~ http://download.epson-europe.com/ ~ 2016 ~ 187 pages.

*Primary Examiner* — Jannelle M Lebron
(74) *Attorney, Agent, or Firm* — Dicke Billig & Czaja PLLC

(57) ABSTRACT

A printing fluid container (100) for use in a printing system is described. An example container includes a base (110) and a light transmissive side wall (120). The side wall extends from the base to define a chamber (130) for receiving and storing printing fluid within the container. The side wall has an internal surface (122) facing the chamber, said internal surface comprising a channel (140). The channel comprises a portion (142) indicating a height from the base, the height representing a predetermined fill amount. The channel is configured such that when the chamber contains printing fluid, printing fluid resides within the channel (140) and indicates the predetermined fill amount.

12 Claims, 4 Drawing Sheets

PRINTING FLUID CONTAINER

BACKGROUND

Printing fluid containers are used in many printer systems, including ink-jet printer systems. Printing fluid containers, such as ink reservoirs, may be filled with a colorant such as ink (or re-filled, after depletion) from a bulk source of printing fluid. Generally, such containers may have a recommended maximum fill level. It is generally undesirable to overfill a container: that is, to supply more fluid to the container than the recommended maximum fill level. Overfilling may negatively affect print quality, and/or cause fluid to leak out of the container onto a user or other components of the printer system. Similarly, it may be undesirable to underfill a printing fluid container. Underfilling may mean that a container is depleted more quickly.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1A:
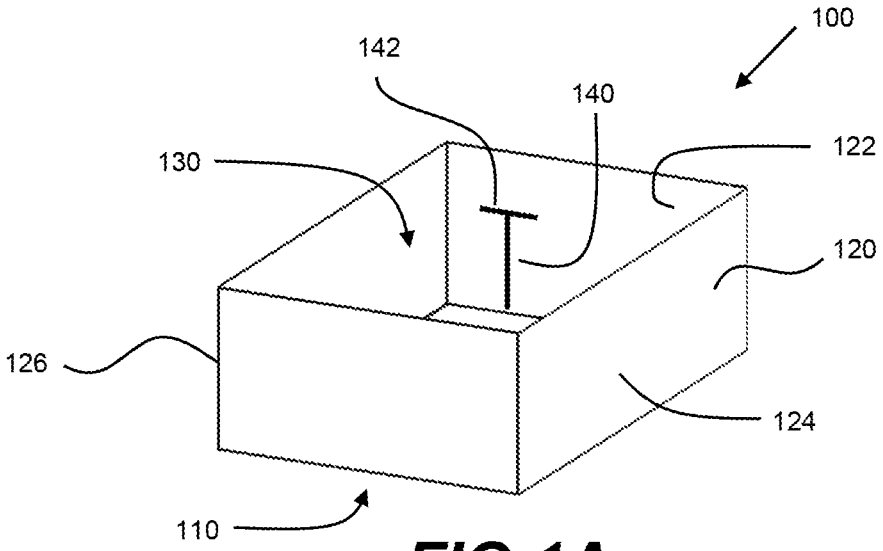
FIG. 1A is a schematic diagram showing an external perspective view of an ink container according to an example.

In the following description, for the purpose of explanation, numerous specific details of certain examples are set forth. Reference in the specification to "an example" or similar language means that a particular feature, structure, or characteristic described in connection with the example is included in at least that one example, but not necessarily in other examples.

Printing fluid containers (also referred to as 'printing fluid reservoirs'), such as those for use with inkjet printers, are configured to contain a printing fluid which may be applied to a medium by a printing system, e.g. to provide an image on the medium. The term "printing fluid" includes all fluids that may be deposited on a print medium from a cartridge, including fluids such as ink, toner, varnish, gloss etc. For ease of explanation, an example of ink is used in descriptions herein; however, this should not be seen as limiting, and the examples may be applied to any printing fluid comprising a colorant. An ink may be an oil or water based ink with one or more colorants, e.g. inks may be supplied as cyan, magenta, yellow and/or black inks. Printing fluid containers containing or configured to contain ink may be referred to as ink containers, or ink reservoirs. A printing fluid container may comprise a part of a printing fluid cartridge. For example, an ink reservoir may comprise a part of an ink cartridge. In some print system examples, printing fluid containers according to the present disclosure may be arranged separately from a printhead apparatus.

Some printer systems may comprise a system configured to receive pre-filled ink containers. That is, containers may be filled with ink before sale, and the container inserted into the printer by a user. Once the container is depleted, the user may replace the empty or depleted container in the printer system with another pre-filled container.

Alternatively, some printer systems may comprise a system configured to receive refillable ink containers. For example, some printer systems may comprise a continuous ink supply system (CISS), wherein a user refills an empty ink container with ink from a bulk source, rather than replacing an empty container with a new, pre-filled ink container.

In both cases, it may be undesirable for the container to be overfilled or underfilled with ink. Accordingly, in certain examples, there are provided herein printing fluid containers which contain an indicator to show a user a predetermined ink fill amount, such as a recommended maximum ink fill amount. A user may supply ink to the container, and use the indicator as a guide to show when the recommended maximum ink fill level has been reached. The term "predetermined ink fill amount" does not refer to a dynamic measurement of an amount of ink present in the container. Rather, the term may be used to refer to a predetermined amount of ink which is to be communicated to a user. The predetermined ink fill amount is not dependent on the amount of ink disposed in the container.

According to the present disclosure, the indicator may comprise a channel (or portion of channel) on an internal surface of the ink container. The term "channel" may refer to a recess in a surface which extends in at least one direction. In some examples, the channel may be configured such that when ink is introduced to the channel, ink moves along the channel by capillary action so that ink resides within the channel. The channel may thus "self-color" with the ink introduced to the channel.

FIGS. 1A to 1E show an ink container according to an example of the present disclosure. FIG. 1A is an external perspective view of ink container 100.

Ink container 100 comprises a base 110. The base is generally the bottom portion of the ink container, and ink may be disposed thereupon within the ink container.

The container 100 further comprises a side wall 120. The side wall may extend substantially all the way around base 110. The side wall 120 may comprise a number of sides (e.g. four are shown in FIG. 1A). The base 110 and side wall 120 together define a chamber 130. Ink may be received and stored in chamber 130, which may be referred to as an ink chamber.

The chamber 130 may have an opening. The opening may be blocked with a lid, for example (not pictured). In some examples, the container 100 may include a removable lid to block the opening to the cavity 130, which may be removed by a user when supplying ink to the container 100. In some examples, ink container 100 is refillable. In some examples, ink container 100 may be configured to be used in a continuous ink supply system (CISS). In some examples, ink container 100 may comprise part of an ink cartridge, the ink cartridge also comprising a printhead unit.

The side wall 120 has an internal surface 122 and an external surface 124. The internal surface faces the chamber 130; the external surface is on the opposite side of the side wall 120, facing away from the chamber 130.

The side wall 120 is a light transmissive side wall. As used herein, "light transmissive side wall" refers to a membrane through which at least some visible light may pass. Put another way, when visible light is incident on one side of the membrane (internal surface 122, for example), at least some may pass through the membrane such that it may be observed on the opposite side of the membrane (when observing external surface 124, for example).

In some examples, a portion of the side wall is light transmissive. In these examples, another portion of the side wall may be opaque: that is, substantially no visible light incident on one side of the wall will pass through the opposite side of the opaque portion. In other examples, substantially all of the side wall may be light transmissive.

In some examples, a portion of the side wall may be transparent. That is, a portion of the side wall may allow light to pass therethrough substantially without scattering of the light. In further examples, substantially all of the sidewall may be transparent.

In other examples, a portion of the side wall may be translucent. That is, a portion of the side wall may allow at least some visible light to pass therethrough, and the light which passes through may be scattered by some amount.

The side wall 120 may comprise a plurality of planar portions, or faces. Faces of the side wall 120 may meet at corners 126. Each face may have an internal surface and an external surface. The term "internal corner" may refer to the point at which internal surfaces of faces meet; the term "external corner" may refer to the point at which external faces meet.

The internal surface 122 comprises a channel 140. The channel 140 comprises a portion 142 indicating a height from the base, the height representing a predetermined ink fill amount. FIGS. 1B to 1E show a face of internal surface 122, extending to internal corners 126 of the side wall, indicating possible configurations of the channel 140.

Figure 1B:
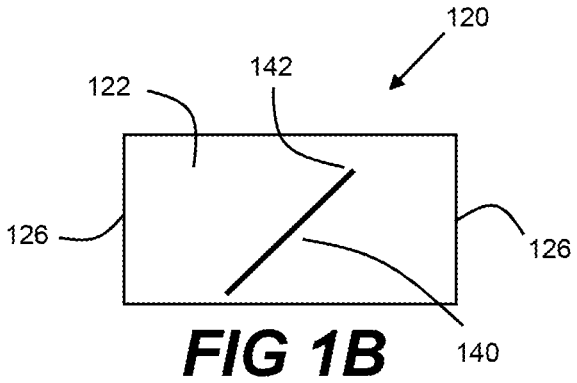
FIGS. 1B to 1E are schematic diagrams showing elevation views of an internal surface of the ink container of FIG. 1A.

For example, FIG. 1B shows an internal surface 122 extending to internal corners 126, the internal surface comprising a channel 140, channel 140 comprising a portion 142 indicating height from the base 110. The channel 140 is arranged in a single direction, substantially diagonal to base 110, wherein the height is indicated by the end of the channel.

Figure 1C:
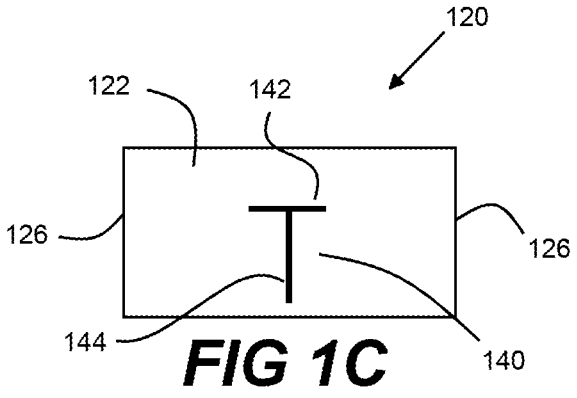

FIG. 1C shows an internal surface 122 extending to internal corners 126, wherein the internal surface comprises a channel 140. The channel 140 comprises a portion 142 indicating height from the base 110 and a portion 144 extending from base 110. In this example, the portion 144 extends from base 110 in a substantially perpendicular direction. Portion 144 may abut base 110, or may be arranged apart from base 110. The portion 142 indicating height from the base 110 is arranged substantially parallel to base 110. The portion 144 extending from the base 110 bisects the portion 142 indicating height from the base.

Figure 1D:
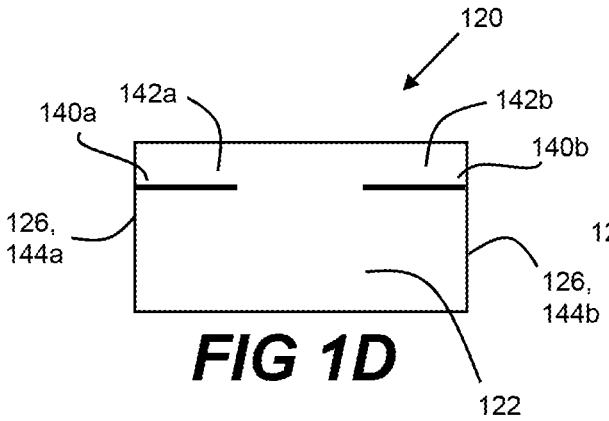

The internal surface 122 may comprise a plurality of channels. For example, FIG. 1D shows an internal surface 122 extending to internal corners 126, the internal surface comprising a first channel 140*a*. The first channel 140 comprises a portion 142*a* indicating height from the base 110. The internal surface 122 also comprises a second channel 140*b*. The second channel 140*b* also comprises a portion 142*b* indicating a height from the base 110. In the example shown in FIG. 1D, each of the channels are arranged to indicate the same fill height, but in other examples a plurality of channels may be used to indicate a plurality of fill heights. In the example shown in FIG. 1D, internal corners 126 may also correspond to portions 144*a* and 144*b* of the channels 140*a* and 140*b* extending from base 110. Accordingly, channel 140*a* may comprise internal corner 126, 144*a* and portion 142*a* indicating fill height; channel 140*b* may comprise internal corner 126, 144*b* and portion 142*b* indicating fill height. In this example, when ink is introduced to the ink container 100, the ink may move along the internal corners 126, 144*a*, 144*b* and into portions 142*a* and 142*b* by capillary action.

Figure 1E:
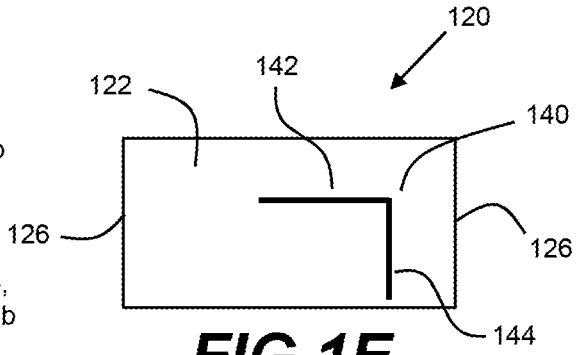

FIG. 1E shows another example of an internal surface 122 extending to internal corners 126, the internal surface comprising a channel 140. In this case, the channel 140 comprises a portion 142 indicating a height from the base 110. Channel 140 also comprises a portion 144 extending from base 110. In this example, the portion 144 extends from base 110 in a substantially perpendicular direction. The portion 142 indicating height from the base 110 is arranged substantially parallel to base 110. Differing from the example shown in FIG. 1D, channel 140 shown in FIG. 1E is arranged in a planar portion (face) of the internal surface.

As described with reference to the examples above, a predetermined ink fill amount indicator formed by a channel on an internal surface of the container may obviate the need for expensive or less accurate methods of indicating fill amounts, such as labelling or electronic monitoring. The channel may comprise an engraving or indentation in the internal surface that enables colored fluid held within a chamber of the container to move along the channel by capillary action, wherein a top of the channel indicates a predetermined measurement of fluid.

FIGS. 2A to 2D show how an ink container 200 according to the present disclosure may look during an ink-filling process. For brevity, features in FIG. 2 and the functions thereof that are the same as those features already described with reference to FIGS. 1A to 1E are given similar reference numerals to those in FIGS. 1A to 1E but increased by 100.

Figure 2A:
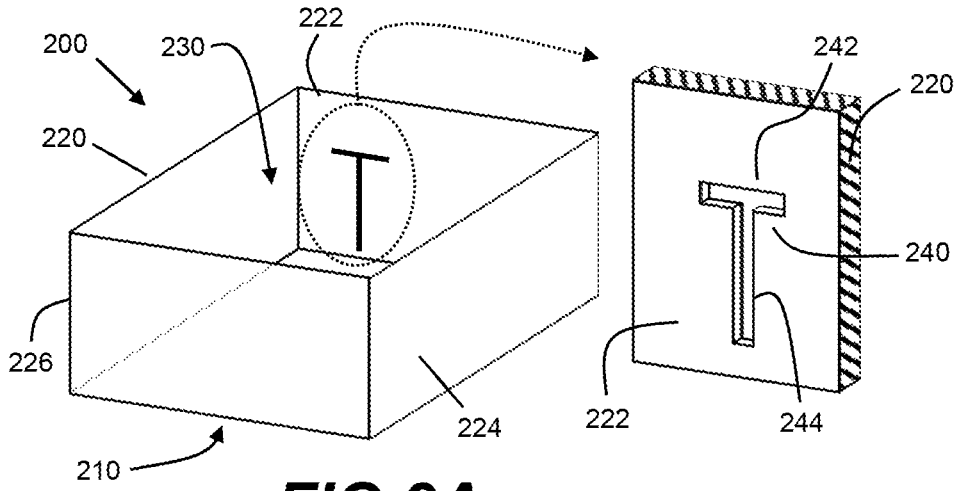
FIGS. 2A to 2D are schematic diagrams showing perspective views of an ink container before and after supplying ink to the container according to an example.

FIG. 2A shows ink container 200 from a first perspective view, including an enlarged view of the area containing channel 240. It can be seen that channel 240, comprising portion 242 indicating a height from base 210 and portion 244 extending from base 210, is a recess in the side wall 220. For the avoidance of doubt, the channel does not extend through the whole thickness of the sidewall 220.

Figure 2B:
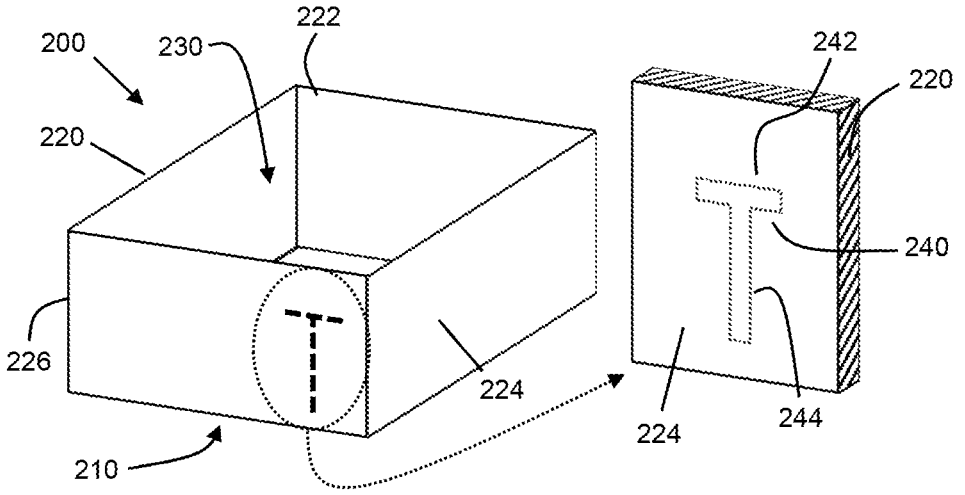

Accordingly, FIG. 2B showing ink container 200 from a second perspective view, indicates that there is no impression in the external surface 224. It may be possible for a user to see the shape of channel 240 when observing the corresponding portion of externals surface 224, as indicated by dashed lines in FIGS. 2B and 2D.

Figure 2C:
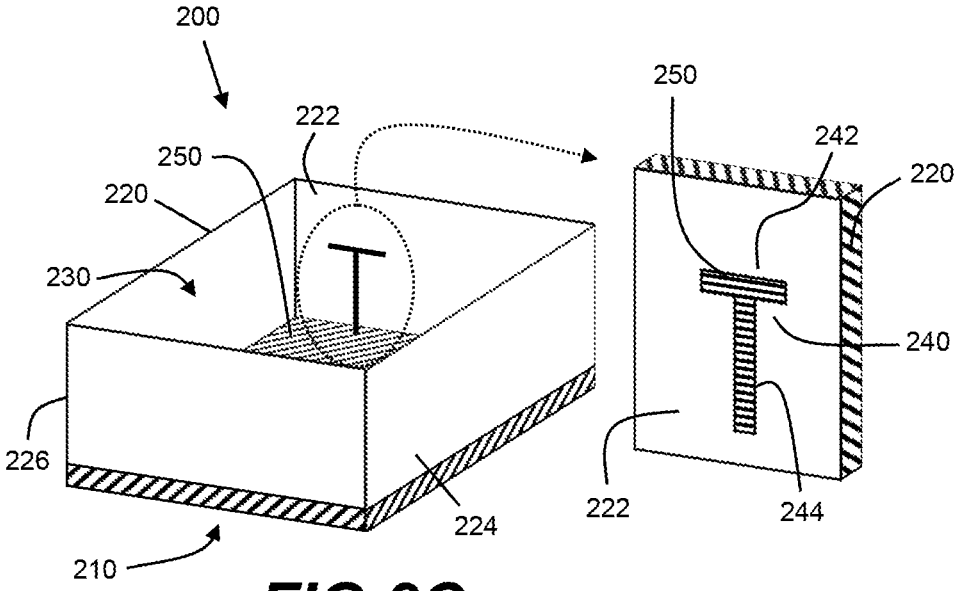

FIG. 2C shows ink container 200 from the first perspective view when ink 250 has been introduced to chamber 230. Ink 250 is disposed on base 210, and is in fluid communication with channel 240. Thus, ink 250 may be introduced to the channel upon supplying the container 200 with ink 250. Ink 250 may move by capillary action along channel 240, filling portions 242 and 244 with ink 250. Thus, when a user begins pouring ink 250 into the container 200, channel 240 may "self-color" or 'wick' along the channel, indicating the predetermined ink fill amount. The ink 250 residing in channel 240 may subsequently dry, leaving a visible ink fill indicator in the same color as the ink 250 in container 200. This may be desirable in printer systems comprising a plurality of ink containers containing different colored inks, so that a user may readily recognize with which color ink each container should be filled, even when said container is fully depleted.

Figure 2D:
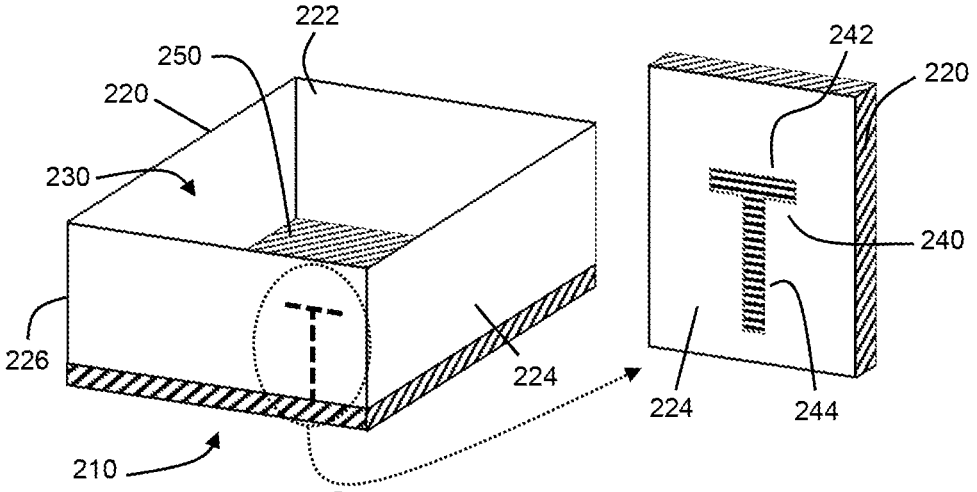

FIG. 2D shows ink container 200 from the second perspective view when ink 250 has been introduced to cavity 230. In these examples, the optical properties of side wall 220 (e.g. degree of light transmissivity) may be configured such that the ink 250 disposed in channel 240 may be visually discerned by a user when viewing the corresponding portion of external surface 224 of side wall 220 shown in FIG. 2D.

Figure 3A:
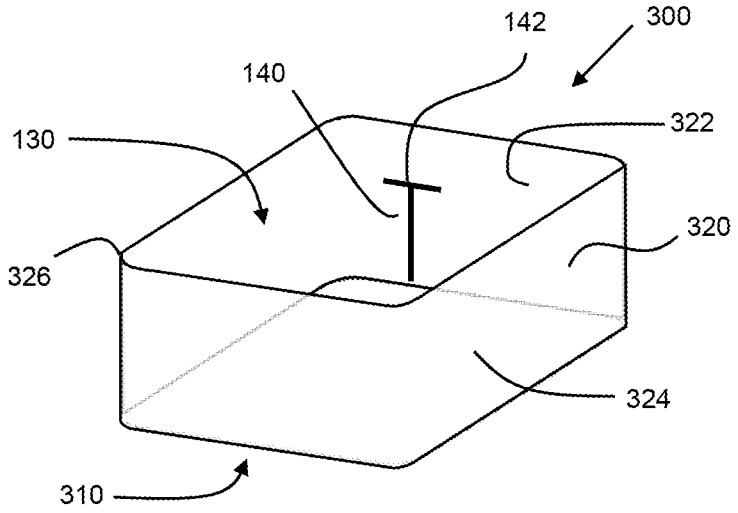
FIG. 3A is a schematic diagram of an external perspective view of an ink container according to another example.
Figure 3B:
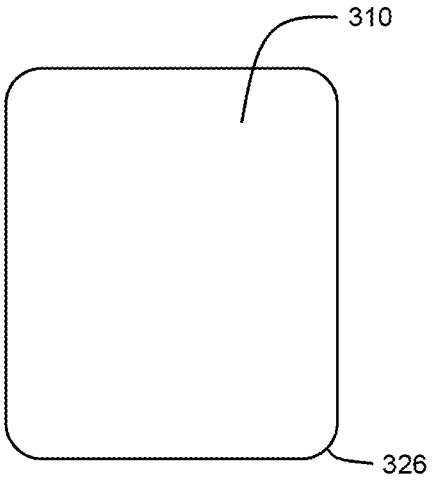
FIG. 3B is a schematic diagram showing a plan view of the ink container of FIG. 3A.

FIG. 3A shows an ink container 300 from a perspective view according to another example of the present disclosure; FIG. 3B then shows a plan view of the ink container 300. For brevity, features in FIGS. 3A and 3B and the functions thereof that are the same as those features already described with reference to FIGS. 2A to 2D are given similar reference numerals to those in FIGS. 2A to 2D but increased by 100.

Ink container 300 comprises rounded corners 326. In particular, container 300 comprises filleted internal corners. In one example, at least one of the internal corners is filleted. In another example, at least two, three or four of the internal corners are filleted. In another example, as shown in FIG. 3A, all of the internal corners of container 300 are filleted. It may be that ink disposed in ink container 300 may not move by capillary action along filleted internal corners. In these examples, then, ink may move by capillary action through channel 340 but not along the corners. Ink containers that contain one feature through which ink may move by capillary action may indicate a predetermined ink fill amount to a user more clearly than a corresponding ink container which contains a plurality of features through which ink may move by capillary action (as a user may not be able to distinguish which feature is intended to indicate the predetermined ink fill amount).

Figure 4:
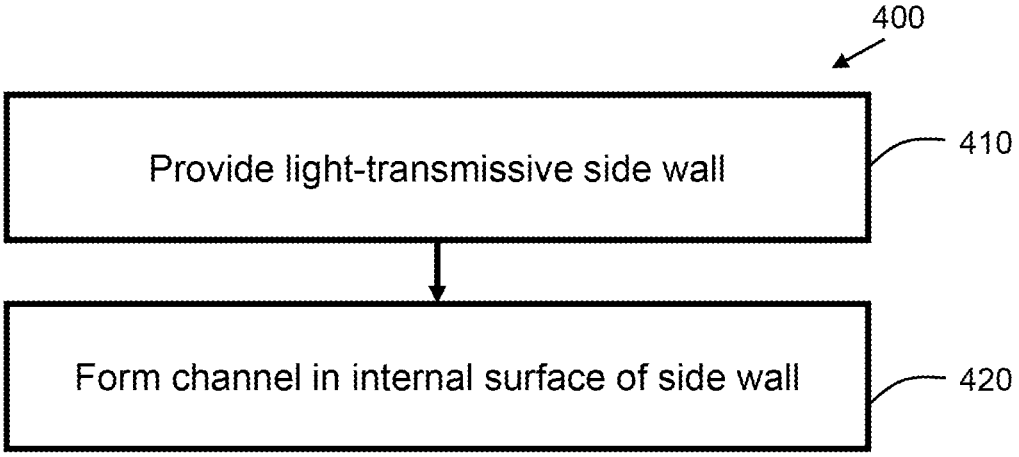
FIG. 4 is a flow diagram showing a method of manufacturing an ink container according to an example.

FIG. 4 shows a method 400 of manufacturing an ink container according to an example. Method 400 includes block 410, which comprising providing a light transmissive side wall for the ink container, wherein the side wall has an internal surface. Block 410 may comprise providing a premolded chamber or planar side wall portion. The side wall is provided such that the internal surface of the light transmissive side wall faces a cavity or chamber. The light transmissive side wall may be provided, for example, by molding a material to provide a cavity defined by a base and a light transmissive side wall (including injection molding), by assembling planar portions of material to provide a cavity defined by a base and a light transmissive side wall, or by ablating a top surface of a material to provide a cavity defined by a base and a light transmissive side wall.

Method 400 further includes block 420, comprising forming a channel in the internal surface, the channel being such that when ink is introduced to the ink container, ink resides within the channel and indicates a predetermined ink fill amount in the ink container.

In some examples, block 420 may comprise engraving the internal surface of the side wall to provide the channel. Engraving may comprise ablating the surface of the side wall with a laser, for example. In other examples, block 420 may comprise etching the internal surface of the side wall to provide the channel.

In some examples, blocks 410 and 420 may be carried out at the same time. For instance, a chamber defined by a base and a side wall may be formed with a mold. Thus, the light transmissive side wall may be provided using a mold of the chamber. The mold may also comprise a feature corresponding to a channel, e.g. a protrusion in a planar surface of the mold that results in the formation of a channel. Accordingly, when providing the light transmissive side wall by molding material to make a chamber, a channel in the light transmissive side wall may be formed concurrently by a feature in the mold corresponding to the channel.

Figure 5:
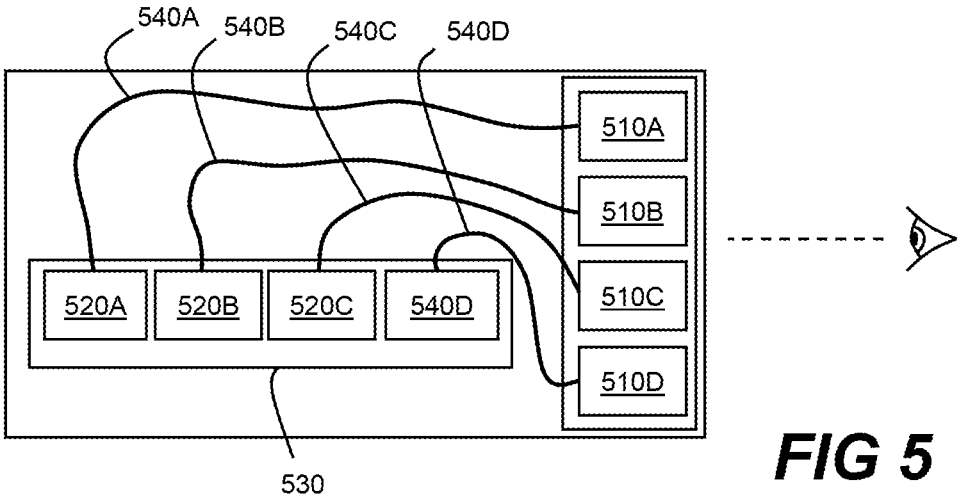
FIG. 5 is a schematic diagram showing a printer system comprising printing fluid containers according to an example.

FIG. 5 shows a plan view of an example of a printer system 500 where printing fluid containers as described herein may be used. The printer system 500 may comprise an ink jet printer system. In FIG. 5, the printer system 500 comprises a plurality of printing fluid containers 510A to D. Although four printing fluid containers are shown in FIG. 5, other numbers of printing fluid containers may be installable in practice. In the example of FIG. 5, each printing fluid container comprises a base, a side wall extending from the base to define a chamber, and an optional upper cover. The printing fluid containers may be used to hold a printing fluid having a colorant, such as ink or a colored gloss or varnish. The printing fluid containers 510A to D may be ink reservoirs, for example. The chamber may be considered similar to the chamber 130, 230 and 330 shown in FIGS. 1A, 2A and 3A, and in use contains printing fluid. The inner surface of the side wall facing the chamber may comprise the aforementioned channel 140, 240 or 340. When printing fluid is disposed in the chamber, the printing fluid may move along the channel by capillary action. The printing fluid may be any of the printing fluid described hereinabove. In some examples, the colorant is an ink, such as a water-based ink.

The printing fluid containers 510A to D may be arranged in the printer system such that, in use, the printing fluid containers remain in a fixed position. In an example, the printing fluid container s are not mounted in a component which moves when the printer is in use, such as a moveable carriage that scans across a print medium.

The printing fluid containers 510A to D may be arranged in the printer system so that, in use, a user may view the light transmissive side wall of each printing fluid container, as indicated in FIG. 5. Accordingly, the printing fluid containers 510A to D may be arranged so that a user may visually discern the portion indicating the height when viewing a corresponding portion of an external surface of the side wall of each printing fluid container.

The printer system 500 may comprise a plurality of printheads 520A to D. The printing fluid containers 510A to D may be arranged separately from printheads 520A to D. Arranging the printing fluid containers 510A to D and the printheads 520A D separately may allow the containers to be refilled or replaced while a print job is in progress.

The printheads 520A to D may be arranged in a print carriage 530. The print carriage 530 may be a static print bar, e.g. in a page wide array printer system. Alternatively, the print carriage may be a moveable carriage that scans over at least a width of a print medium.

Each printhead 520A to D may comprise a jetting mechanism, such as a piezo electric member and nozzle for ejecting drops of printing fluid supplied from the each printing fluid container 510A to D.

Each printhead and printing fluid container may be connected by a conduit 540A to D. A needle may be disposed at an end of each conduit 540A to D, each needle being arranged in the chamber of each printing fluid container 510A to D to collect printing fluid from the container. In examples wherein the printing fluid containers 510A to D include an upper cover, the needle may pass through the upper cover into the chamber. A system configured as described hereinabove may be referred to as a continuous ink supply system (CISS).

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. An ink container for a printing system comprising:

a base; and a light transmissive side wall, the side wall extending from the base to define a chamber for receiving and storing ink within the ink container;

wherein the side wall has an internal surface facing the chamber, a channel is formed in the internal surface of the side wall, and the channel includes a portion extending from the base and a portion indicating a height from the base, wherein the portion indicating the height from the base is arranged substantially parallel to the base and the portion extending from the base bisects the portion indicating the height from the base, the height representing a predetermined ink fill amount, and wherein, when the chamber contains ink, ink contacts and resides within the channel to indicate the predetermined ink fill amount.

2. The ink container of claim 1, wherein the portion extending from the base comprises an internal corner of the sidewall.

3. The ink container of claim 1, wherein the channel is arranged in a planar portion of the internal surface.

4. The ink container of claim 1, wherein the side wall comprises one or more internal corners, and at least one of the internal corners is a filleted internal corner.

5. The ink container of claim 1, wherein the side wall comprises two or more internal corners, and each of the two or more corners are filleted internal corners.

6. The ink container of claim 1, wherein the ink moves by capillary action along the channel so that the ink resides within the channel.

7. The ink container of claim 1, wherein the ink container is refillable.

8. The ink container of claim 1, wherein the sidewall is translucent, and ink within the channel may be visually discerned by a user when viewing a corresponding portion of an external surface of the side wall.

9. A method of manufacturing an ink container for use in a printer, the method comprising:

providing a base and a light transmissive side wall extending from the base to define a chamber for the ink container, the side wall having an internal surface facing the chamber; and forming a channel in the internal surface of the side wall, the channel including a portion extending from the base and a portion indicating a height from the base, the portion indicating the height from the base arranged substantially parallel to the base and the portion extending from the base bisecting the portion indicating the height from the base, the channel being such that when ink is introduced to the chamber of the ink container, ink contacts and resides within the channel to indicate a predetermined ink fill amount for the ink container.

10. The method of claim 9, wherein the channel is formed by engraving the internal surface to provide the channel.

11. The method of claim 9, wherein the channel is formed using a feature in a mold for the chamber of the ink container during the formation of the side wall.

12. A printer system comprising:

a plurality of printing fluid containers, each printing fluid container being refillable and comprising:

a base;

a light transmissive side wall, the side wall extending from the base to define a chamber, the chamber containing a printing fluid having a colorant;

wherein the side wall has an internal surface facing the chamber, a channel is formed in the internal surface of the side wall, and the channel includes a portion extending from the base and a portion indicating a height from the base, wherein the portion indicating the height from the base is arranged substantially parallel to the base and the portion extending from the base bisects the portion indicating the height from the base, the height representing a printing fluid fill amount, wherein, in use, the portion of the channel indicating the height from the base is to be contacted by and contain colorant, such that a user may visually discern the portion indicating the height when viewing a corresponding portion of an external surface of the side wall.

* * * * *